US010443823B2

(12) United States Patent
Béland et al.

(10) Patent No.: US 10,443,823 B2
(45) Date of Patent: Oct. 15, 2019

(54) MOUNT INTERACE FOR LIGHT FIXTURES

(71) Applicant: AXIS LIGHTING INC., Lasalle (CA)

(72) Inventors: Stephane Béland, Lasalle (CA); Jamie Katz, Lasalle (CA); Andrew Miles, Lasalle (CA); Howard Yaphe, Lasalle (CA)

(73) Assignee: Axis Lighting Inc., LaSalle (CA)

( * ) Notice: Subject to any disclaimer, the term of this patent is extended or adjusted under 35 U.S.C. 154(b) by 44 days.

(21) Appl. No.: 15/885,759

(22) Filed: Jan. 31, 2018

(65) Prior Publication Data

US 2019/0234590 A1 Aug. 1, 2019

(51) Int. Cl.
*F21V 21/03* (2006.01)
*F21V 21/005* (2006.01)
(Continued)

(52) U.S. Cl.
CPC ..... *F21V 21/03* (2013.01); *F21S 8/03* (2013.01); *F21V 21/005* (2013.01); *F21V 21/088* (2013.01)

(58) Field of Classification Search
CPC .... F21S 8/03; F21S 8/046; F21S 8/061; F21S 2/005; F21S 4/20; F21S 4/28;
(Continued)

(56) References Cited

U.S. PATENT DOCUMENTS 6,464,179 B1 * 10/2002 Bulvan ..... H02G 3/20 248/317
6,702,453 B2 3/2004 Weedon
(Continued)

OTHER PUBLICATIONS

Esse-Ci Srl, ISDI_Diamante (to the best of the Applicant's knowledge and understanding, the reference does not have a specific publication date but is believed to have been known by the Applicant on or after Dec. 1, 2017. Applicant believes it may have been available before the priority date of the application because the earliest date relating to this material that could be located online is Apr. 2017).

(Continued)

*Primary Examiner* — Peggy A Neils
(74) *Attorney, Agent, or Firm* — Barnes & Thornburg LLP

(57) ABSTRACT

A mounting assembly for mounting a light fixture comprises a plurality of anchor structures attachable to a ceiling at designated locations thereon to form an anchor array to be patterned so as to be complementary with a target location array of a plurality of target locations on the light fixture. A plurality of elongate flexible structures is provided according to the anchor array, each configured to extend from a corresponding anchor structure so as to be orientable to align with a corresponding target location in the target location array when the target location array is unaligned with the anchor array. A plurality of retainers is provided according to the anchor array, each configured to be positionable at a distal location on the corresponding elongate flexible structure, thereby to suspend the light fixture below the ceiling. Each retainer being displaceable along the corresponding elongate flexible structure to collectively displace the light fixture toward engagement with the ceiling, wherein the retainer is positionable at a designated location on the elongate flexible structure, wherein an installed position of the light fixture is defined by a cumulative effect of a relative positioning of each anchor location and each corresponding target location.

19 Claims, 14 Drawing Sheets

(51) Int. Cl.
*F21S 8/00* (2006.01)
*F21V 21/088* (2006.01)

(58) Field of Classification Search
CPC ..... E04B 9/067; E04B 9/10; E04B 9/90006; F21Y 2103/00
See application file for complete search history.

(56) References Cited

U.S. PATENT DOCUMENTS

| | | | | |
|---|---|---|---|---|
| 7,293,895 | B2 | 11/2007 | Grossman et al. | |
| 7,735,794 | B1 * | 6/2010 | Gretz | E04B 9/006 248/200.1 |
| 2009/0296381 | A1 | 12/2009 | Dubord | |
| 2013/0050997 | A1 | 2/2013 | Bretschneider et al. | |
| 2014/0226316 | A1 * | 8/2014 | Medendorp, Jr. | F21S 8/043 362/147 |
| 2015/0338068 | A1 | 11/2015 | Bolscher | |
| 2015/0364853 | A1 | 12/2015 | Thijssen | |
| 2017/0082253 | A1 | 3/2017 | Sorensen et al. | |
| 2018/0313503 | A1 * | 11/2018 | Sonneman | F21S 8/063 |

OTHER PUBLICATIONS

GES Lighting Track System, GES 1-Circuit Global Track System (to the best of the Applicant's knowledge and understanding, the reference does not have a specific publication date but is believed to have been known by the Applicant on or after Dec. 1, 2017. Applicant believes it may have been available before the priority date of the application because the earliest date relating to this material that could be located online is Jun. 2017).
Lighting Services Inc., Recessed Track Installation (2015).
Lumenalpha™ spot, 209272, lumenpulse Global Tek 100 track system installation instructions (2016).
Lytespan Track lighting 9100 (1999).
Philips, Lytespan, Basic, 1 Circuit Track 6000 (2015).
WAC Lighting, J Series 2 Circuit Track (2012).

* cited by examiner

MOUNT INTERACE FOR LIGHT FIXTURES

REFERENCE TO CO-PENDING APPLICATIONS

The subject matter of the following co-pending applications is incorporated by reference in their entireties:

a) U.S. application filed Oct. 20, 2016 under Ser. No. 15/299,168 and entitled COUPLERS FOR LIGHT FIXTURES;

b) U.S. application filed Mar. 2, 2017 under Ser. No. 15/447,841 filed and entitled CANOPY INTERFACE FOR A CEILING MOUNT; and c) U.S. application filed Jan. 31, 2018, under Ser. No. 15/885,742 and entitled CONDUIT ACCESS FOR LIGHT FIXTURES; and d) the following U.S. design applications:

1. application Ser. No. 29/623,018, filed Oct. 20, 2017 entitled LIGHT FIXTURE;
2. application Ser. No. 29/601,125, filed Apr. 19, 2017, entitled LIGHT FIXTURE; and
3. application Ser. No. 29/601,129, filed Apr. 19, 2017, entitled LIGHT FIXTURE COMPONENT U.S.D29/601129.

FIELD OF THE DISCLOSURE

The present disclosure relates to light fixtures and associated structures.

BACKGROUND

Pendant light fixtures are typically mounted to ceilings, such as with a t-bar ceiling configuration, by way of a hanger clip and a suspension structure.

In contrast to pendant light fixtures, flush mount or fixed mount light fixtures are typically mounted directly against the ceiling by a threaded stud extending downwardly from a junction box or a t-bar clamp. Linear flush mount light fixtures have an array of passages therein requires a complementary array of studs in the ceiling. The task to align the passages in the light fixture with the corresponding supposedly aligned studs in known to be a tedious, if not time-consuming procedure, which is increasingly difficult to achieve with the increasing number mounting points and studs in the respective arrays.

It would thus be desirable to provide novel approaches for the mounting of light fixtures, or at least to provide the public with one or more useful alternatives.

SUMMARY

In one aspect, there is provided a mounting assembly for mounting a light fixture, comprising a plurality of anchor structures attachable to a ceiling at designated locations thereon to form an anchor array. The anchor array is configured to be patterned so as to be complementary with a target location array of a plurality of target locations on the light fixture according to the anchor array. A plurality of elongate flexible structures is provided according to the anchor array, of which each elongate flexible structure is configured to extend from a corresponding anchor structure in the anchor array so as to be orientable to align with a corresponding target location in the target location array. A plurality of clamp structures is provided according to the anchor array, of which each clamp structure is configured to be positionable on the corresponding elongate flexible structure and displaceable therealong to bring the light fixture toward the ceiling. Each each clamp structure is releasably lockable at a designated location on the corresponding elongate flexible structure, thereby to provide corresponding effective spacings between corresponding anchor structures and clamp structures to bring the light fixture into engagement with the ceiling, with the anchor and target location arrays in general alignment, wherein an installed position of the light fixture is defined by a cumulative effect of a relative positioning of each anchor location and each corresponding target location.

In some exemplary embodiments, each array may each include at least two sub-arrays each extending in a designated direction.

In some exemplary embodiments, the elongate flexible structure may include at least one cable, cable tie, rope, cord and/or chain.

In some exemplary embodiments, each clamp structure may include a passage to receive the elongate flexible structure and a releasable lock element to lock the clamp structure at the designated location.

In some exemplary embodiments, the elongate flexible structure may include a cable and the clamp structure may include a cable gripper.

Some exemplary embodiments may further comprise a guide configured to extend outwardly from the anchor structure to guide and/or locate the light fixture at the installed position.

In some exemplary embodiments, the guide may include at least one guide structure with an exterior profile to engage an inner region of the light fixture.

In some exemplary embodiments, the guide may include a pair of guide formations on opposite sides of the anchor structure. The guide formations may have at least one surface to engage corresponding surfaces on the light fixture.

In another aspect, there is provided a light fixture assembly, comprising a plurality of anchor structures attachable to a ceiling at designated locations thereon to form an anchor array. At least one light fixture body defines a target location array of a plurality of target locations according to the anchor array. A plurality of elongate flexible structures is provided according to the anchor array, of which each elongate flexible structure is configured to extend from a corresponding anchor structure in the anchor array so as to be orientable to align with a corresponding target location in the target location array. A plurality of clamp structures is provided according to the anchor array, of which each clamp structure is configured to be positionable on the corresponding elongate flexible structure and displaceable therealong to bring the light fixture body toward the ceiling, each clamp structure being releasably lockable at a designated location on the corresponding elongate flexible structure, thereby to provide corresponding effective spacings between corresponding anchor structures and clamp structures to bring the light fixture body into engagement with the ceiling, with the anchor and target location arrays in general alignment, wherein an installed position of the light fixture body is defined by a cumulative effect of a relative positioning of each anchor location with the corresponding target location.

In some exemplary embodiments, the light fixture body may comprise a longitudinal extrusion defining a longitudinal axis, with a lateral cross section defined by an inner frame portion and a pair of outer boundary portions, wherein the target location array extends along the longitudinal axis.

In some exemplary embodiments, the pair of outer boundary portions may provide a pair of edge regions which are configured to engage the ceiling on respective opposite sides of the designated first locations.

In some exemplary embodiments, the inner frame portion is configured to define the target location array to be spaced from the pair of edge regions to define a passage through which each elongate flexible structure extends between the first location and the second location.

In some exemplary embodiments, the passage may include a cavity between the frame portion and the boundary portions through which each elongate flexible structure extends between the first location and the second location.

In some exemplary embodiments, the light fixture body may be configured to shroud each clamp structure and the corresponding elongate flexible structure to limit access to a region therebetween, as the clamp structure approaches the designated location on the elongate flexible structure.

In some exemplary embodiments, the light fixture body may include a chamber extending around a peripheral region of the clamp structure, wherein at least at the designated location on the elongate flexible structure.

In some exemplary embodiments, the chamber may be formed on a chamber member that is removably mountable to an inner surface of the light fixture body.

In another aspect, there is provided a mounting assembly for mounting a light fixture, comprising a plurality of anchor structures attachable to a ceiling at designated locations thereon to form an anchor array to be patterned so as to be complementary with a target location array of a plurality of target locations on the light fixture. A plurality of elongate flexible structures is provided according to the anchor array, each configured to extend from a corresponding anchor structure so as to be orientable to align with a corresponding target location in the target location array when the target location array is unaligned with the anchor array. A plurality of retainers according to the anchor array, each configured to be positionable at a distal location on the corresponding elongate flexible structure, thereby to suspend the light fixture below the ceiling. Each retainer is displaceable along the corresponding elongate flexible structure to collectively displace the light fixture toward engagement with the ceiling. The retainer is positionable at a designated location on the elongate flexible structure, wherein an installed position of the light fixture is defined by a cumulative effect of a relative positioning of each anchor location and each corresponding target location.

In another aspect, there is provided a method of mounting a light fixture on a ceiling, comprising:

a. locating a plurality of anchor structures on the ceiling at designated locations to form an anchor array, in a pattern so as to be complementary with a target location array of a plurality of target locations on a light fixture;

b. locating each of a plurality of elongate flexible structures at a corresponding anchor structure, so that each elongate flexible structure extends from the corresponding anchor structure in the anchor array so as to be orientable to align with a corresponding target location in the target location array;

c. providing a plurality of clamp structures, each to engage a corresponding elongate flexible structure according to the anchor array, so that each clamp structure is displaceable along a path defined on the corresponding elongate flexible structure in a direction to bring the light fixture toward engagement with the ceiling;

d. releasably locking each clamp structure at a designated location on the corresponding elongate flexible structure, thereby to provide corresponding effective spacings between corresponding anchor structures and clamp structures to releasably lock the light fixture in an installed position on the ceiling with the anchor and target location arrays in general alignment;

wherein the installed position is defined by a cumulative effect of a relative positioning of each anchor location with a corresponding target location.

In some exemplary embodiments, each target location may include an aperture, further including extending each elongate flexible structure through a corresponding aperture.

BRIEF DESCRIPTION OF THE FIGURES

Several exemplary embodiments of the present disclosure will be provided, by way of examples only, with reference to the appended drawings, wherein.

DETAILED DESCRIPTION

Figure 1:
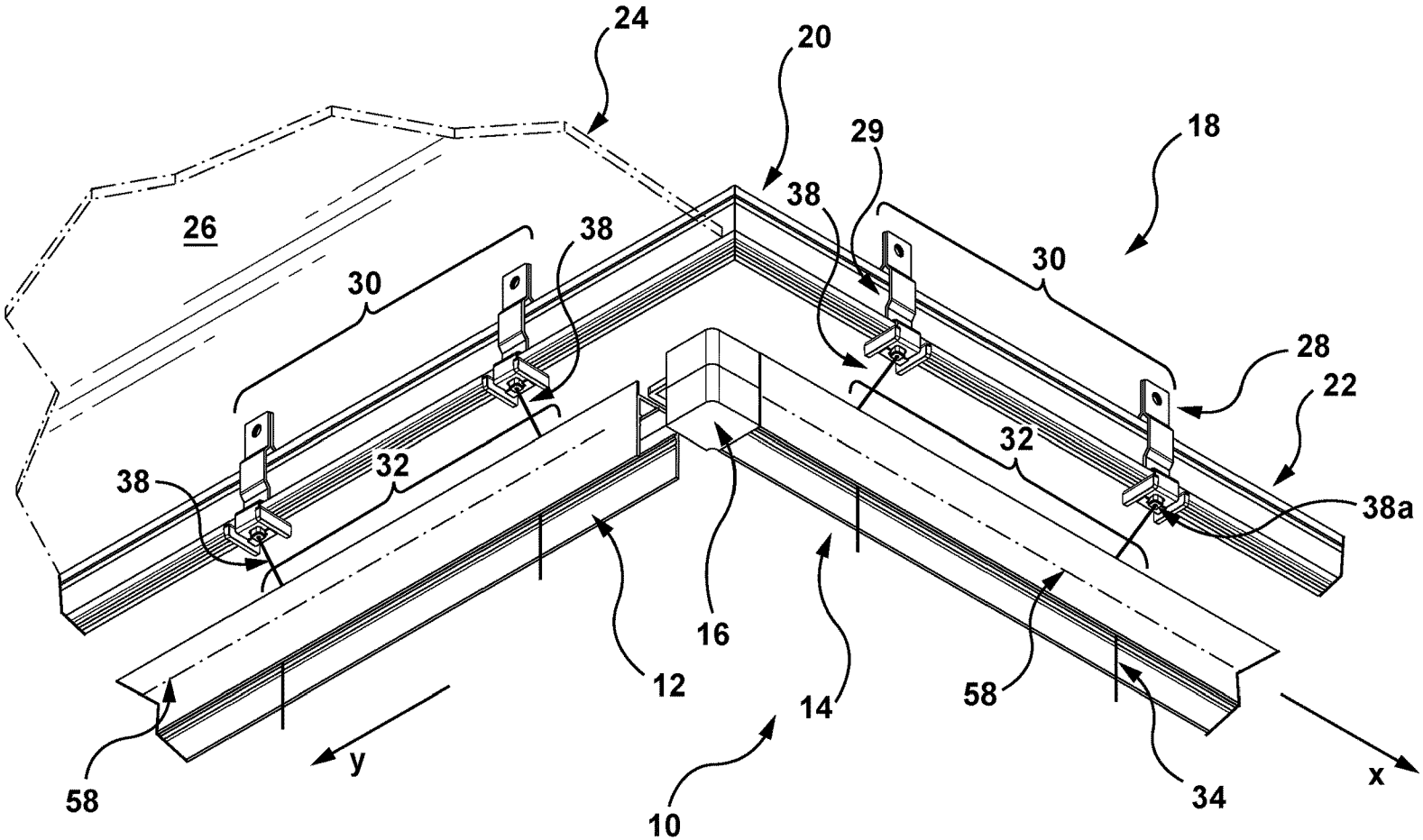
FIGS. 1 to 4 are fragmentary perspective views of a portion of a light fixture assembly.

It should be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical, mechanical or other connections or couplings. The terms upper, lower, and vertical are intended for operative context only and are not necessarily intended to limit the invention only to those configurations or orientations. Furthermore, and as described in subsequent paragraphs, the specific mechanical and/or other configurations illustrated in the drawings are intended to exemplify embodiments of the invention. However, other alternative mechanical and/or other configurations are possible which are considered to be within the teachings of the instant disclosure.

The term "elongate flexible structure" is intended to mean a structure which is flexible along its length, such as under a force of gravity, between spaced locations thereon, according to the relative positions of the locations.

Figure 12:
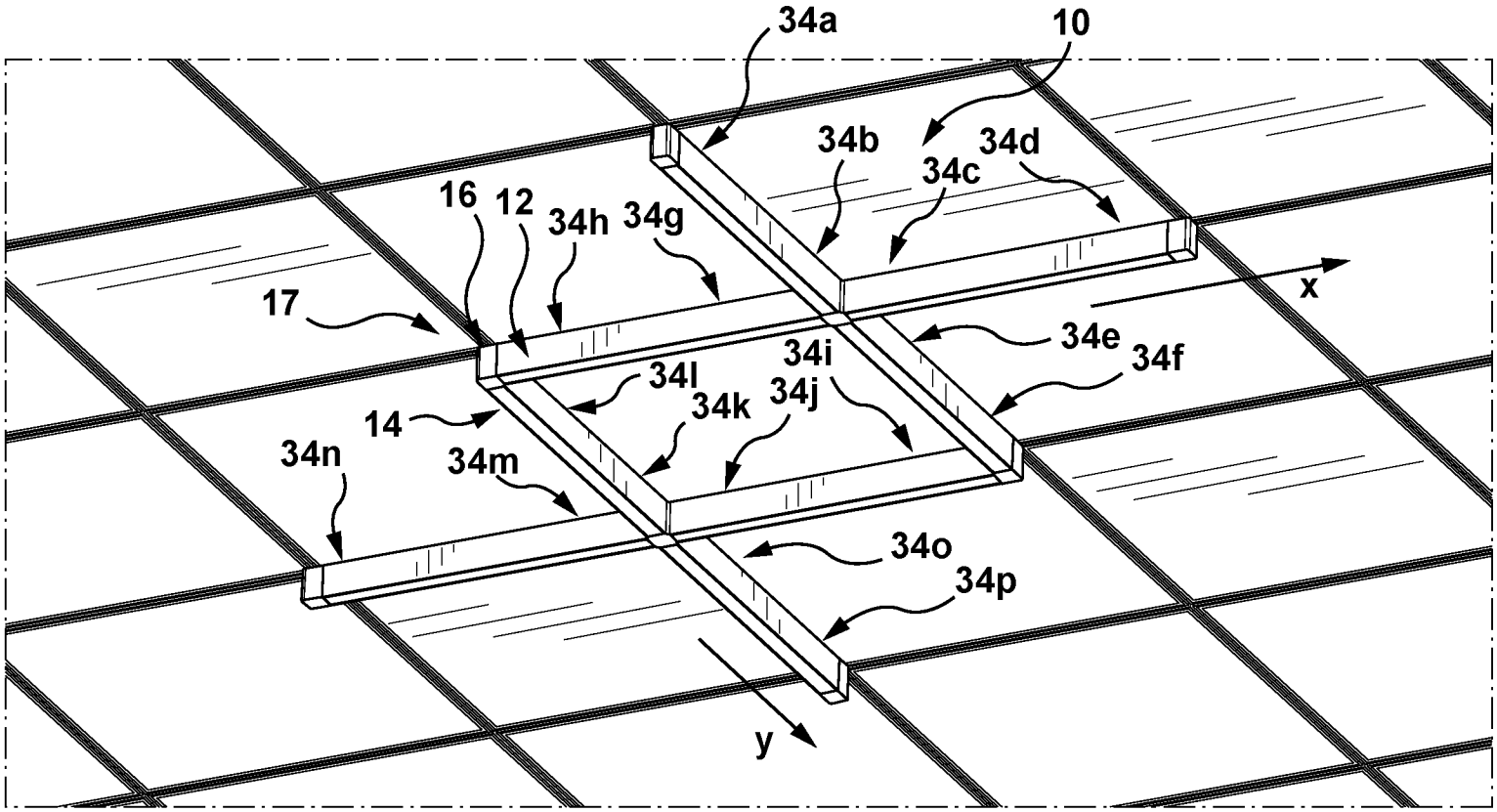
FIG. 12 is a perspective view of the light fixture of FIG. 1 in an operative configuration.

FIG. 1 shows a segment of a linear light fixture 10, including two housing sections 12, 14 joined at a coupler 16. A number of such sections are assembled to form a light fixture body 17 as shown in FIG. 12. In this instance, the light fixture body 17 takes the form of relatively complex structure denoted by the fact that it has a plurality of housing sections in at least two dimensions x and y, with at least one intersection between them formed by the coupler 16. Features and functions of the coupler 16 are found in application Ser. No. 15/299,168.

Referring again to FIG. 1, a mounting assembly is also generally provided at 18 for mounting the light fixture 10 to a ceiling 20. In this exemplary embodiment, the ceiling 20 is formed in part by a t-bar assembly 22 supporting a number of ceiling panels 24 to define a ceiling surface 26.

As can be generally seen in FIG. 1, the mounting assembly 18 includes a plurality of anchor structures 28, in the form of t-bar clamps, which are attachable (and in this exemplary embodiment attached), at designated locations 29 (referred to as anchor locations) in this instance on a t-bar ceiling grid of ceiling 20, to form an anchor array made up of, in this exemplary embodiment, a pair of sub-arrays in the x and y directions, as shown generally at brackets 30. The anchor array 30 is patterned so as to be complementary with a target location array, similarly made up of a pair of sub-arrays in the x and y directions, as represented generally by brackets 32, of a plurality of target locations 34 on the light fixture 10, according to the anchor array.

Figure 6:
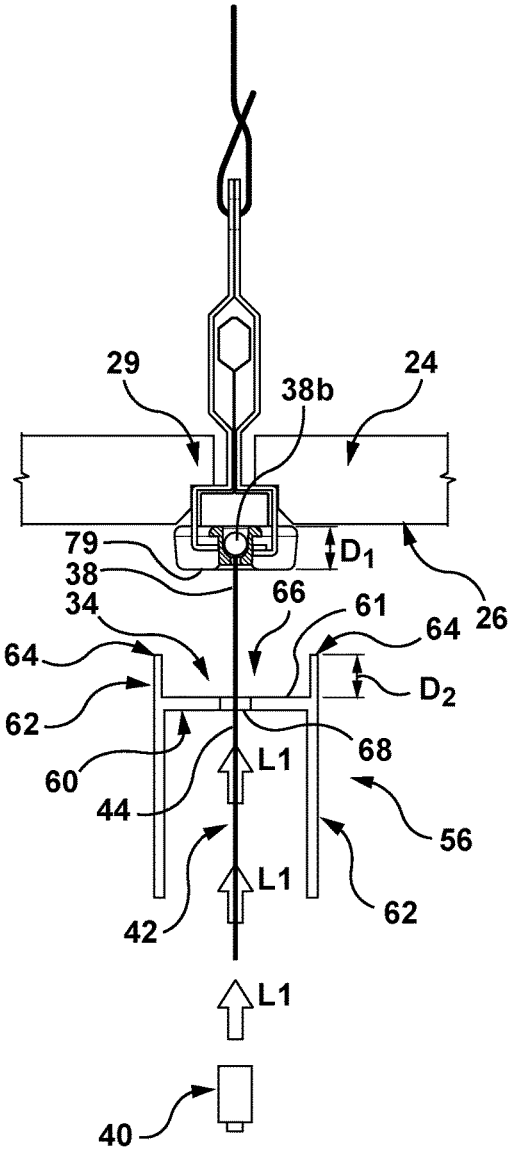
FIGS. 6 and 7 are sectional views of portions of the light fixture assembly FIG. 1.

Also provided is a plurality of elongate flexible structures 38, according to the anchor array, and in this exemplary embodiment each may be provided as a cable. Each elongate flexible structure 38 has an end region 38*a* provided with an anchor ball 38*b* (FIG. 6). Each elongate flexible structure 38 is thus configured to extend from a corresponding anchor structure 28 so as to be orientable at a distance therefrom, to align with a corresponding target location 34 in the target location array 32.

Figure 3:
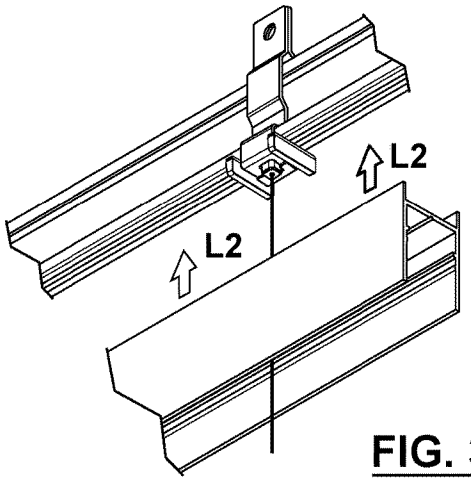
Figure 2:
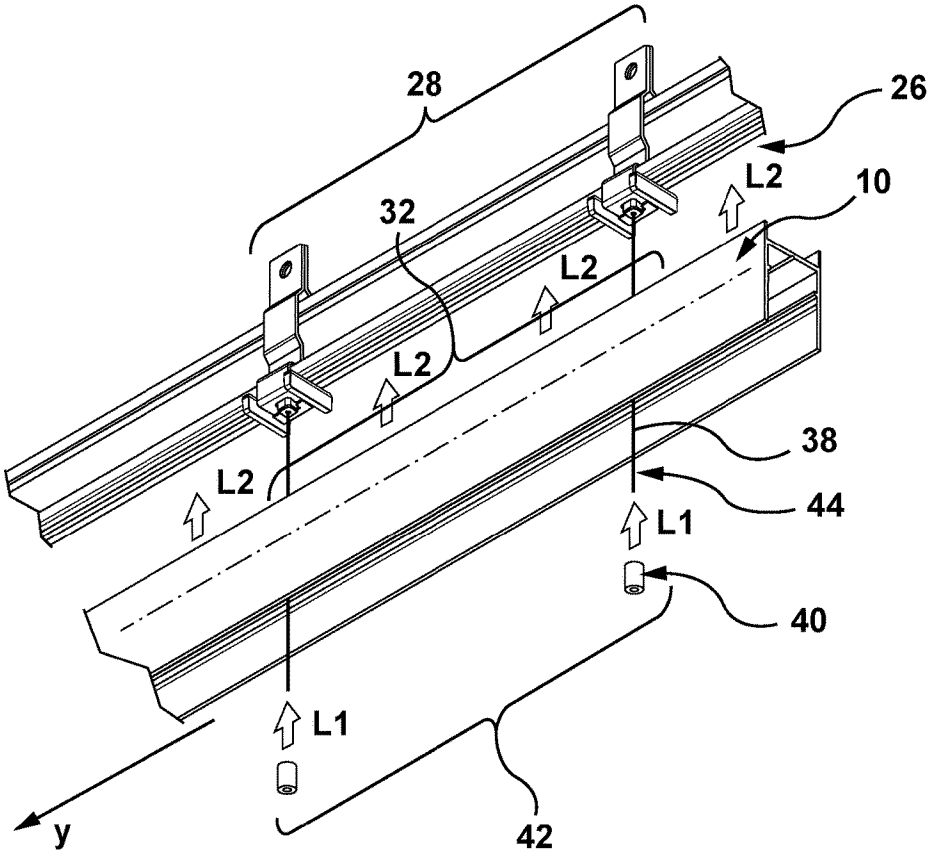

Referring to FIGS. 1 to 3, 6 and 7, a plurality of clamp structures 40, according to the anchor array, is also provided at bracket 42, of which each clamp structure 40 is configured to be displaced along a path 44 defined along the corresponding elongate flexible structure 38 in a direction as shown by arrows L1 in FIG. 2, to bring light fixture 10 toward the ceiling surface 26, as shown by arrows L2 in FIGS. 2 and 3. Each clamp structure 40 is releasably lockable at a designated location as shown at 46 in FIG. 7 on the corresponding elongate flexible structure 38, thereby to provide corresponding effective spacings (generally represented by dimension S) between corresponding anchor structures 28 and clamp structures 40 (and in this exemplary embodiment referenced by surface 61 as described below) to bring the light fixture 10 into engagement with the ceiling 20 with the anchor and target location arrays 30, 32 in general (or approximate) alignment. As will be discussed, an installed (and/or operative) position of the light fixture 10 may be defined by a cumulative effect of a relative positioning of each anchor location 29 and each corresponding target location 34.

As shown in FIG. 1, the elongate flexible structure 38, in some exemplary embodiments, may include one or more cables, cable ties, ropes, cords and/or chains or the like. The clamp structure 40 may be provided in a number of forms, to function to releasably clamp or lock, as a retainer to releasably retain, in a manner to be able to be positioned at designated locations along path 44 to position the light fixture 10 relative to the ceiling 20, including in the installed position.

Figure 7:
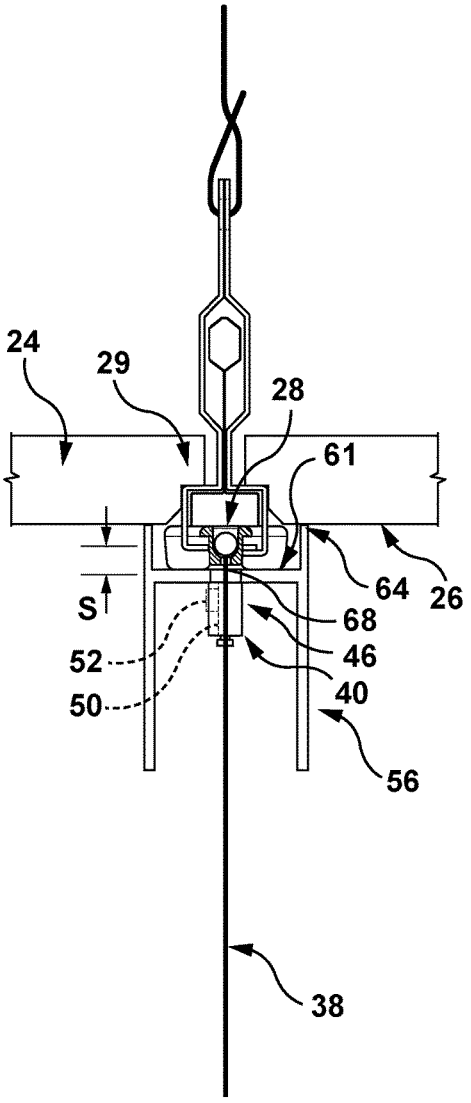

In some exemplary embodiments, as shown in FIG. 7, each clamp structure 40 may include a passage as shown schematically at 50 to receive the elongate flexible structure 38 and a releasable lock element, shown schematically at 52, to lock the clamp structure 40 at the designated location 46 on the elongate flexible structure. The passage 50 may be an inner passage, or defined on an outer boundary of each clamp structure 46. The passage 50 may be elongate, as defined by a longitudinal axis of the clamp structure 46. Alternatively, the passage 50 may be defined between at least one movable clamping element relative to another movable or relatively static locating or clamping element. For example, the elongate flexible structure 30 may be a cable and the anchor structure may be a cable gripper, such as a Griplock Reverse Release Gripper, model ZF-12-NT-RR, available from www.griplocksystems.com.

Figure 5:
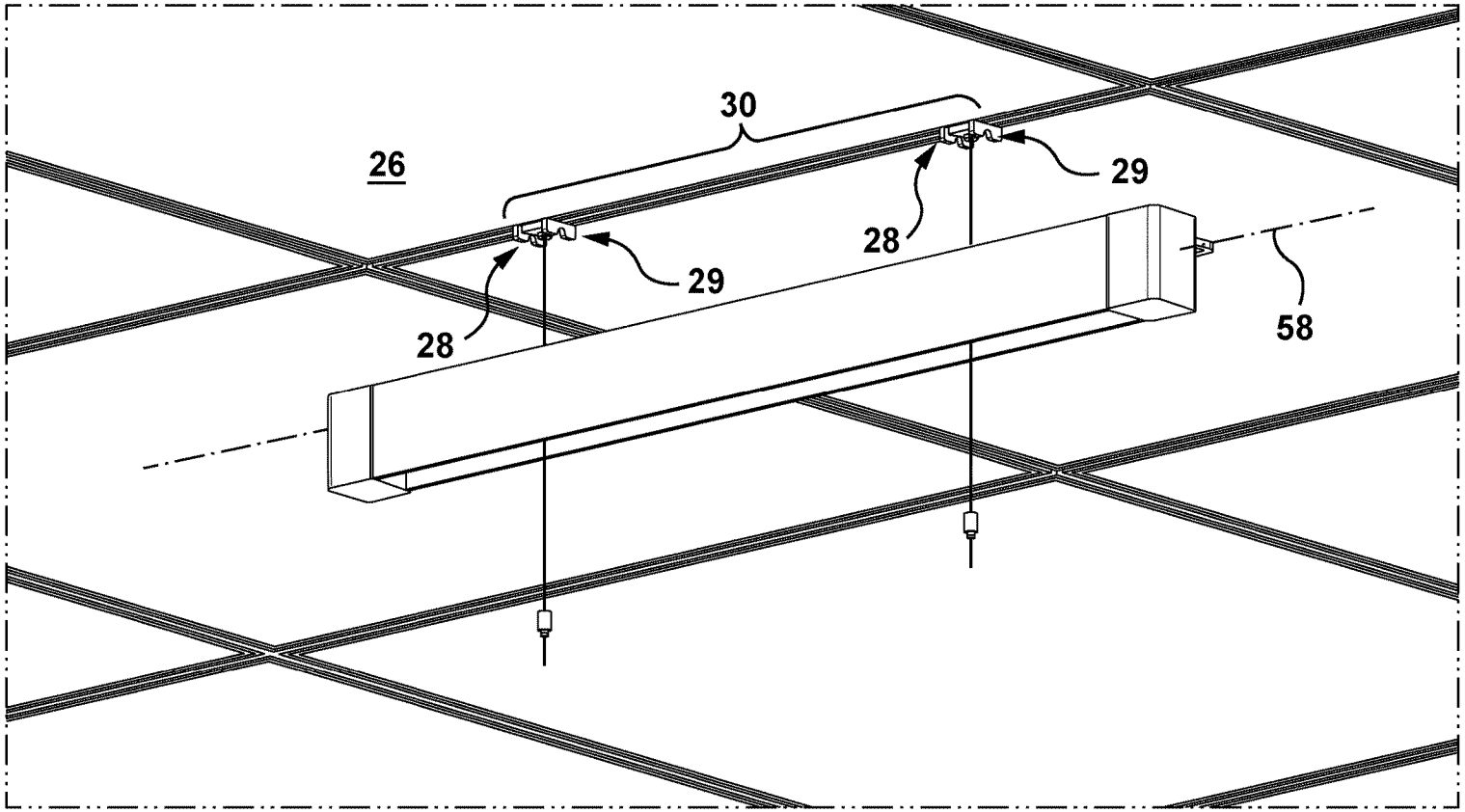
FIG. 5 is a perspective view of a section of the light fixture assembly of FIG. 1.

In some exemplary embodiments, the housing sections 12, 14 may be provided in the form of a longitudinal extrusion defining a longitudinal axis, one of which shown at 58 in FIGS. 1 and 5, with a lateral cross section such as that shown in FIGS. 6 and 7. An inner frame portion is provided at 60, which in this example is generally perpendicular to a pair of outer boundary portions 62, and wherein the target location array 32 extends along the longitudinal axis 58.

In some exemplary embodiments, the pair of outer boundary portions 62 provides a pair of edge regions 64 which are configured to engage the ceiling surface 26 (or be immediately adjacent thereto, so as to present substantially no perceptible or accessible gap therebetween) on respective opposite sides of the anchor locations 29, when the light fixture 10 is in the installed position.

In some exemplary embodiments, the inner frame portion 60 is configured to provide the target location array 32 to be spaced from the pair of edge regions 64 to define a passage 66 through which each elongate flexible structure 38 extends between the corresponding anchor location 29 and the target location 34. The passage 66 may thus bounded by the inner frame portion 60 and the boundary portions 62 forming an elongate cavity.

In some exemplary embodiments, each target location 34 may include an aperture such as that shown at 68, extending through the inner frame portion 60 (FIGS. 6 and 7), so that each elongate flexible structure 38 may extend through such corresponding aperture, to receive the clamp structure 40.

Figure 8A:
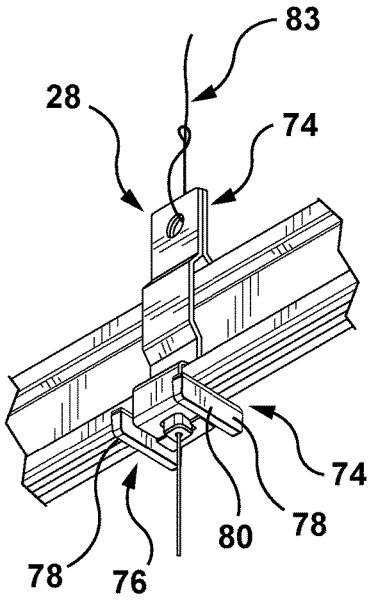
FIGS. 8A and 8D are fragmentary perspective and fragmentary sectional views of another portion of the light fixture assembly of FIG. 1.
Figure 9B:
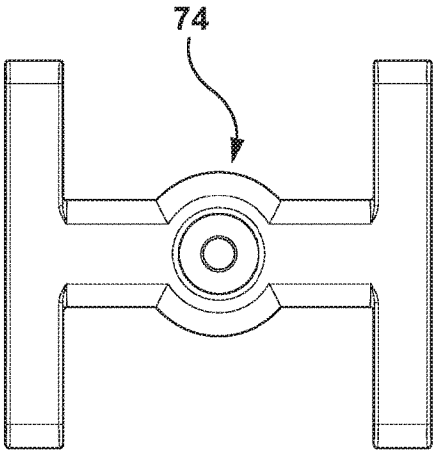
FIGS. 9A to 9D are perspective, plan, perspective and sectional views, respectively, of a component of the light fixture assembly of FIG. 1.
Figure 9D:
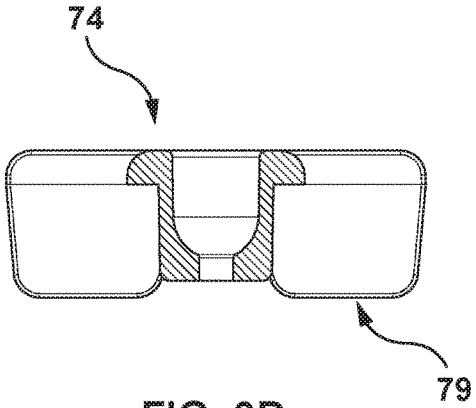
Figure 9A:
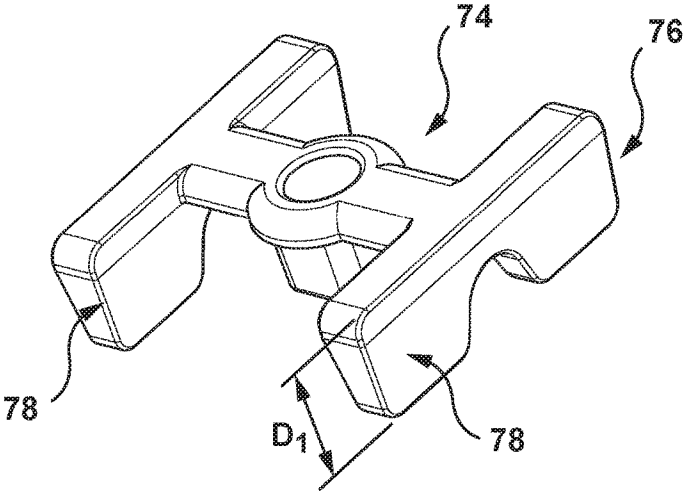
Figure 9C:
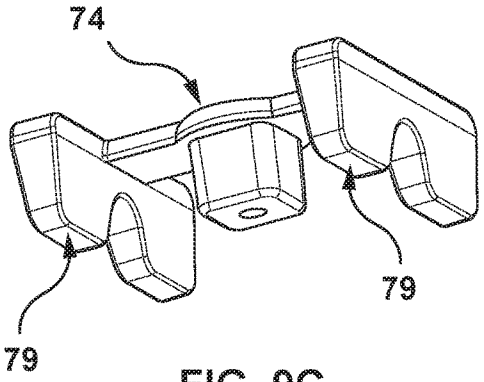

Referring to FIGS. 8*a* and 8*d*, 9*a* to 9*d*, 10*a* and 10*b*, in some exemplary embodiments, the anchor structure 28 may be seen in the form of the t-bar clamp 72, and may include or support a guide 74 which is configured to extend downwardly from the t-bar clamp 72 to guide and/or locate the corresponding housing section 12, 14 at the installed position (or operative position). The guide 74 may include one or more guide structures 76 with an exterior profile to engage an inner region of the light fixture 10. The guide structure 76 may include a pair of guide formations 78 on opposite sides of the t-bar clamp 72, wherein the guide formations may be provided with lower outer surfaces 79 to engage an upper surface 61 (FIG. 6) of the inner frame portion to locate the light fixture in relation to the anchor structure 28. Thus, the upper surface 61 and the lower surface 79 provide a locating interface for each corresponding anchor location and target location in the respective arrays. This may be beneficial for linear light fixtures or other structurally complex light fixtures of some exemplary embodiments, to be flush mounted so that the ceiling panel 24, which may otherwise be resting on the t-bar grid, is not displaced out of its operative resting position thereon, by a neighboring edge region. Thus, as shown in FIGS. 6 and 9A, the depth dimension D1 of the guide formations 78 may be arranged to match or to be otherwise complementary with, the depth D2 of the corresponding surface 61 on the inner frame portion 60 relative to the edge regions 64.

Figure 8B:
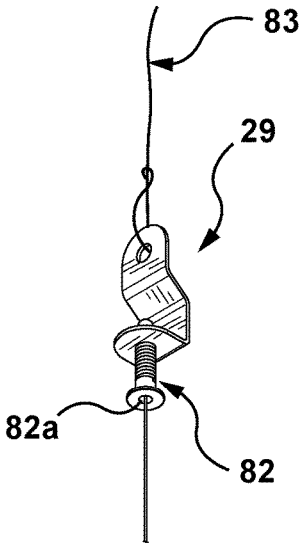
FIGS. 8B, 8E and 8C, 8F are fragmentary perspective and fragmentary sectional views of portions of alternative light fixture assemblies.
Figure 8C:
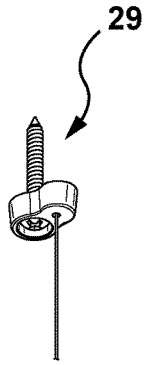
Figure 8D:
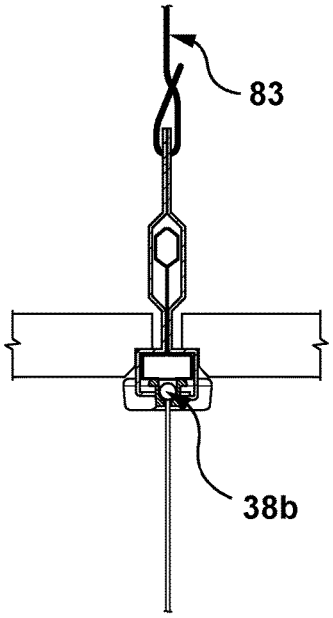
Figure 8E:
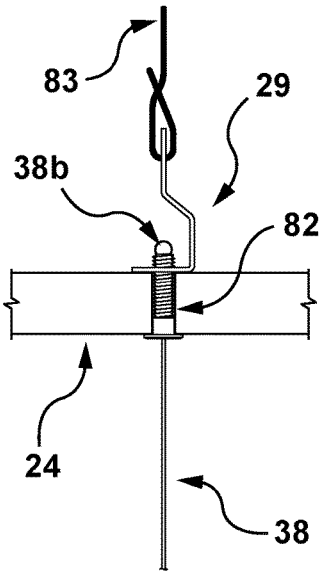
Figure 8F:
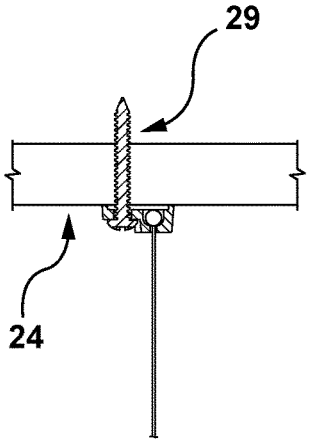

Exemplary embodiments are shown in FIGS. 8B, 8E and 8C, 8F that may be deployed for ceiling structures that utilize anchor structures 29 that are attachable directly to a fixed ceiling panel 24, as opposed to removable ceiling panels positioned on t-bar assembly 22 or the like. In the case of FIGS. 8B, 8E, a ceiling panel 24 may be supported by a fastener 82 which itself is suspended by a cord 83 (in a manner similar to cord 83 supporting the t-bar clamp 72) and which provides a passage 82*a* to receive the elongate flexible structure 38, whereas in FIGS. 8C, 8F, the anchor structure is fastened directly to a ceiling panel 24 of plaster, cement or the like. In each of the above examples, the end region 38*a* includes anchor ball 38*b* which is held in the respective anchor structure. In other exemplary embodiments, the anchor ball 38*b* may be replaced with other forms of end regions to facilitate anchoring in the associated anchor structure.

Figure 11A:
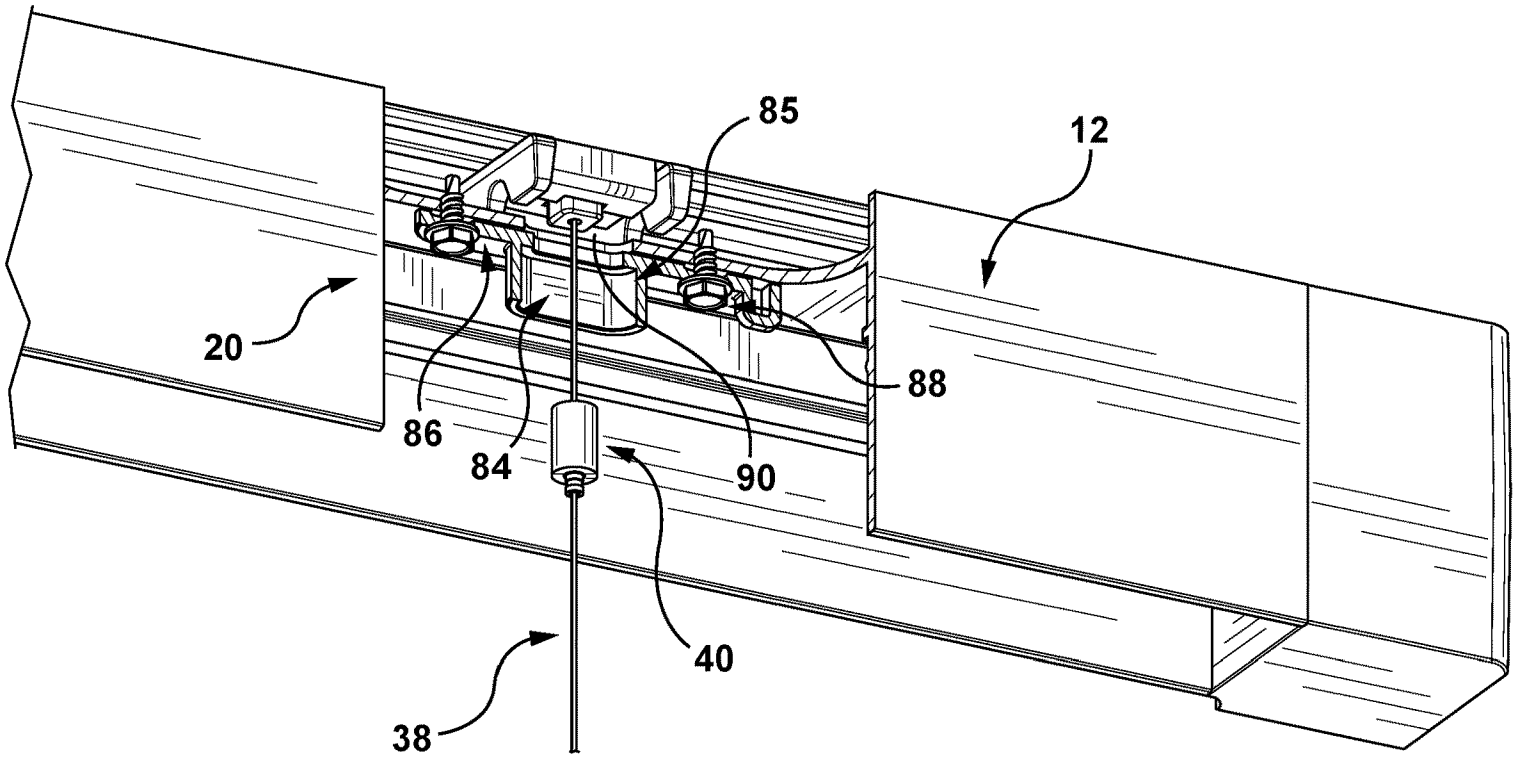
FIGS. 11A to 11D are perspective views of a portion of the light fixture assembly of FIG. 1 in several configurations.
Figure 11B:
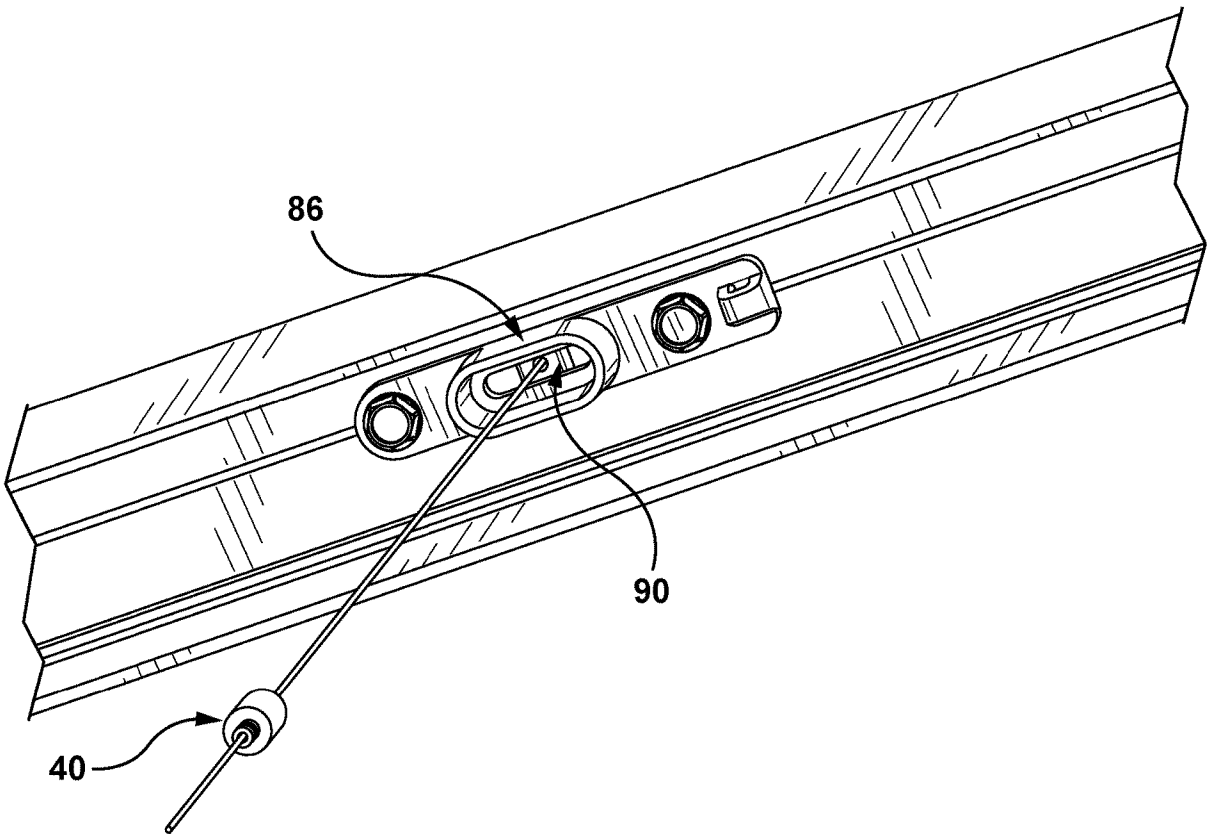
Figure 11C:
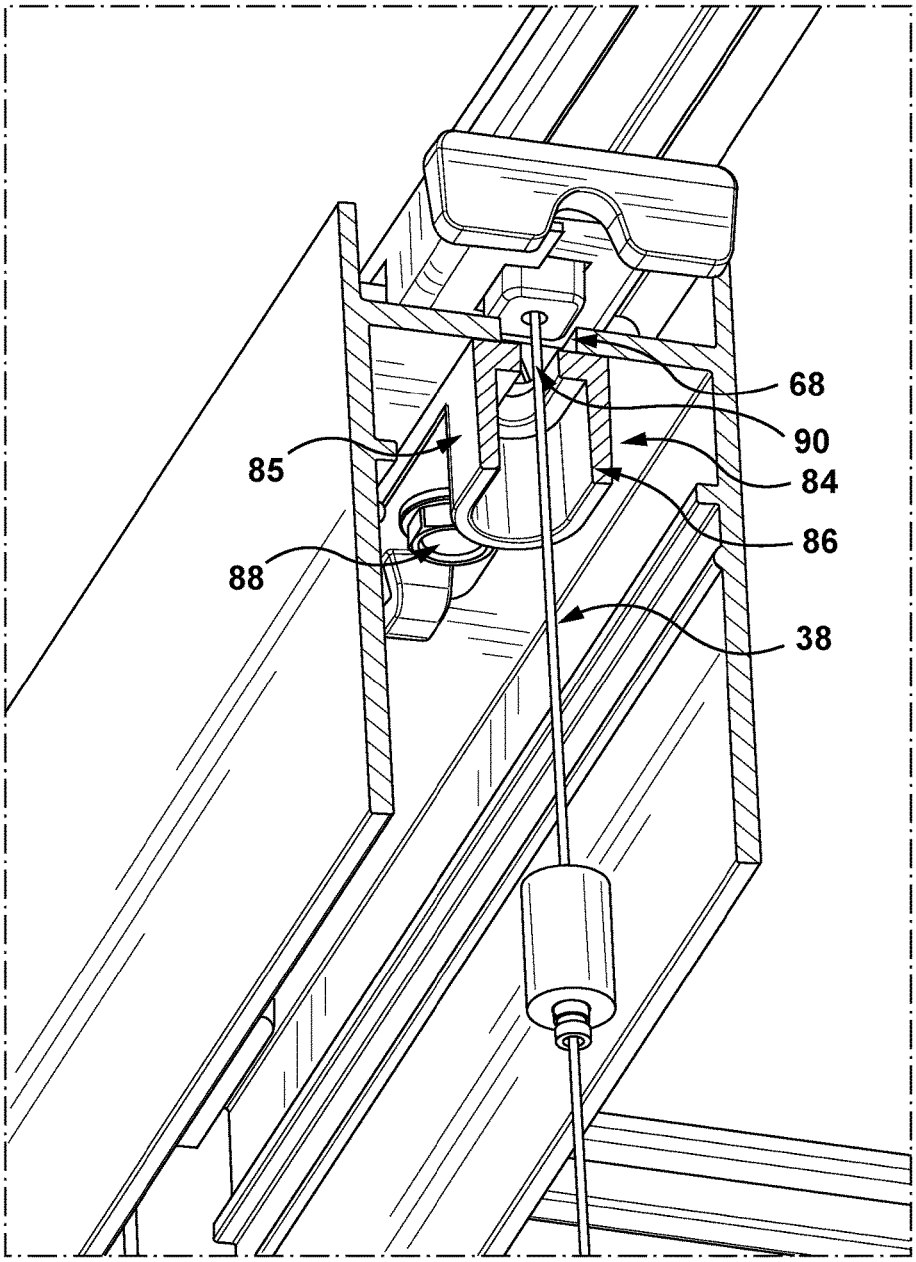
Figure 11D:
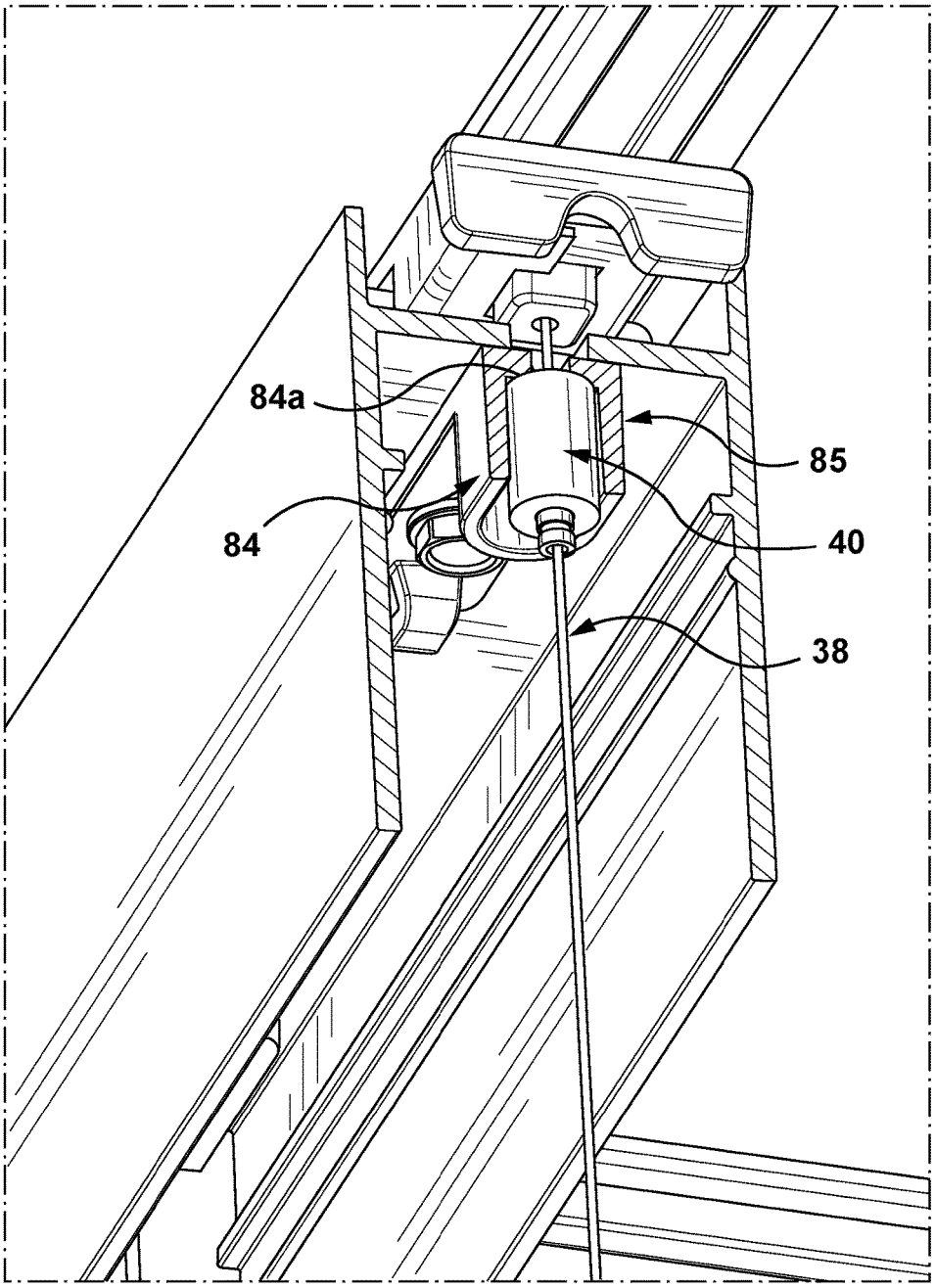

In some exemplary embodiments, as illustrated in FIGS. 11A to 11D, the housing section 12 may be configured to shroud each clamp structure 40 and the corresponding elongate flexible structure 38 to limit access thereto, as the clamp structure 40 approaches its installed position. Thus, a shroud may be further provided by a chamber 84 defined by a barrier wall 85 extending around a peripheral region of the clamp structure 40 at least in the installed position, as shown in FIG. 11D. The chamber 84 may be formed on a chamber member 86 which is removably mountable to an inner surface of the housing by way of a pair of fasteners 88. The chamber member 86 presents the chamber 84 in the form of a cup structure to provide a central passage 90 to align with the aperture 68 and thus may be in the form of a circular hole or a slot, the latter of which may provide some additional variance in the position of the elongate flexible member 38 in the translated position as discussed below. Thus, the shrouding effect of the clamp structure in the installed position, in some cases, provides a barrier from extraneous objects, such as power lines, from being inadvertently pinched in the space between the camp structure 40 and the inner surface 84*a* of the chamber 84, as seen in FIG. 11D.

Referring to FIGS. 1 to 4, 6, 7 and 12, in some exemplary embodiments, a method of mounting the light fixture 10 on a ceiling 20 may involve locating a plurality of the anchor structures 28 on the ceiling 20 at designated anchor locations 29 to form the anchor array 30. This may be carried out, for example, by installing the t-bar clamps 29 at the spaced locations along the t-bar assembly 22 as can be seen for four such t-bar clamps 29 in a pattern so as to be complementary with a target location array 32 of a plurality of target locations 34 on an assembled light fixture 10 according to the anchor array. For instance, if the structure of the light fixture 10 were to have sixteen designated target locations 34, as seen by the target locations 34*a* to 34*p* in FIG. 12, then sixteen t-bar clamps 72 would be installed at the correspondingly designated sixteen anchor locations 29.

Next, each of a plurality of elongate flexible structures 38 may be positioned to extend from a corresponding anchor structure 28 in the anchor array 30, so as to be orientable to align with a corresponding target location in the target location array 32.

Figure 10A:
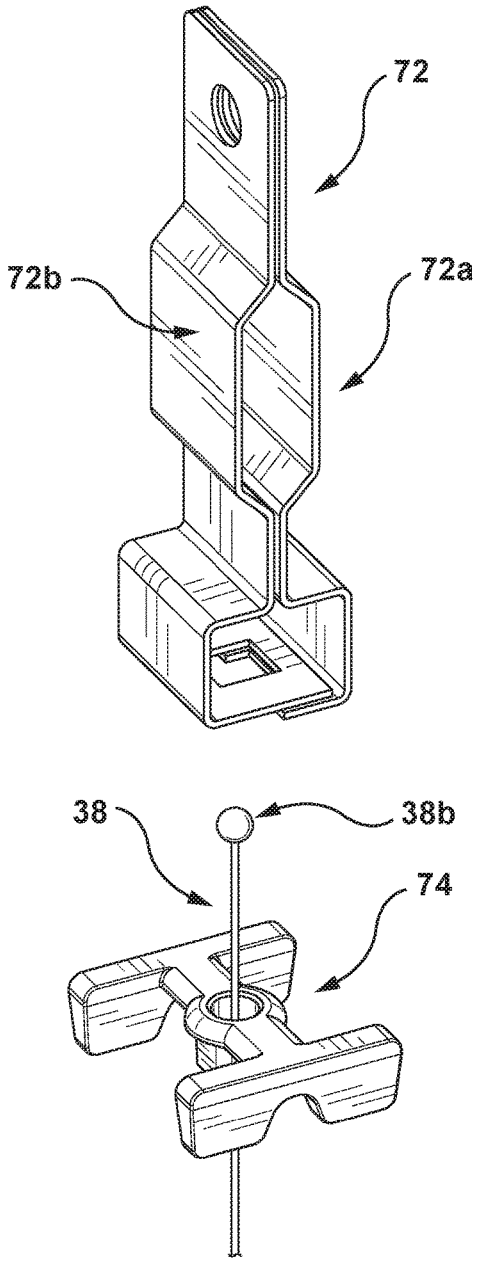
FIGS. 10A and 10B are perspective views of a sub-assembly of a portion of the light fixture assembly of FIG. 1.
Figure 10B:
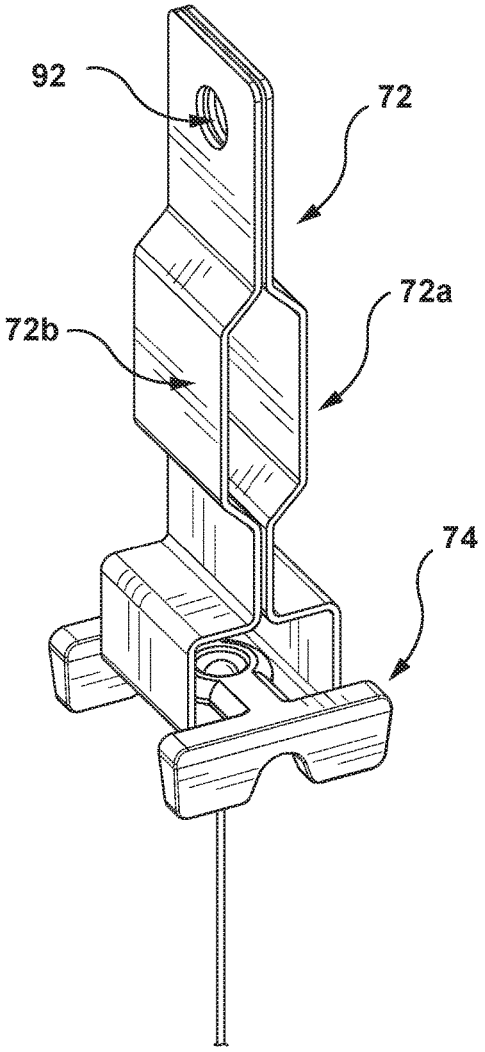

Thus, in the above example, an elongate flexible structure 38 would each be installed on a corresponding t-bar clamp 29, for a total of sixteen elongate flexible structures, either after the t-bar clamp is installed or, as shown in the exemplary embodiment of FIGS. 1 to 8A, pre-assembled with the t-bar clamp before it is installation at the corresponding anchor location. Referring to FIGS. 10A and 10B, this may involve bringing complementary halves 72*a*, 72*b* of the t-bar clamp 72 together to engage the guide 74 which may then be held together in this example by a cord 83 extending through the passage and tied to itself as shown in FIG. 8A (though other fastening approaches may also be used).

Figure 4:
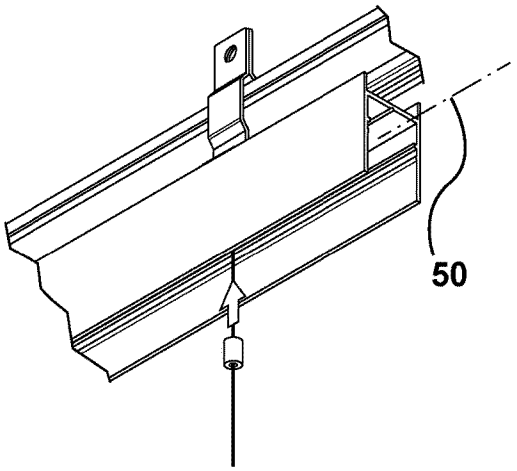

Next, as shown in FIGS. 2 to 4, the elongate flexible structures 38 may then each be fed through a corresponding aperture 68 and each of clamp structure 40 may then be installed on a corresponding elongate flexible structure 38. Each clamp structure 40 may then be displaced along the path 44 defined on the corresponding elongate flexible structure 38 in a direction to bring the light fixture 10 toward installed engagement with the ceiling surface 26 in the direction of arrows L2 (FIGS. 2, 3 and 4). Each clamp structure 40 may then be releasably locked at the designated location 46 on the corresponding elongate flexible structure 38 corresponding to location where the edge regions 64 make contact with the ceiling surface 26, and/or where the upper surface 61 of the inner frame portion 60 makes contact with the lower upper surface of the guide formations 78 along the light fixture in the above example, to positively locate the elevation of the light fixture relative to the t-bar grid, thereby to provide corresponding effective spacings between corresponding anchor structures 38 and clamp structures 40 to operatively position lock the light fixture 10 in relation to the ceiling surface 26 with the anchor and target location arrays 30 and 34 in general alignment, so that an installed position of the light fixture 10 may be defined by a cumulative effect of a relative positioning of each anchor location 29 with a corresponding target location 34.

The cumulative effect of a relative positioning of each anchor location and each corresponding target location may provide particular advantages to both the assembly and installation of the light fixture 10. Using the elongate flexible structures, such as cables, may enable local misalignments to be accommodated in a holistic way. Note for instance, that in the exemplary embodiment of FIG. 1, the elongate flexible structures 30 are not strictly vertical between the light fixture 10 and the array of anchor structures. Instead, the light fixture 10 is shown in FIG. 1, for illustration purposes, to demonstrate a case where a dimensional variation between the spacing of the target location array 32 does not align, at each instance of a target location, with a corresponding one of the anchor locations in the anchor array 30. By contrast, were target and anchor arrays 32, 30 to align, the elongate flexible structures 38 would be expected to be in vertical orientations above the light fixture 10 (as they are shown to be in FIG. 1 while extending below the light fixture 10). Thus, the elongate flexible structures are able to adopt a position in which any one or more of such misalignments may result in the light fixture translating slightly from an aligned position (where no such misalignment were to occur) to a translated position, which may in most cases be essentially indistinguishable an unaided eye of a person in the illumination provided by such light fixture.

The cumulative effect of a relative positioning of each anchor location and each corresponding target location may provide a number of benefits that may become more pronounced with an increasing number of anchors and target locations arising from an increasingly complex-shaped light fixture, such as the exemplified embodiment in FIG. 10, for example when the light fixture is fully or partially preassembled before installation on the ceiling surface. In this case, the cumulative effect of a relative positioning of each anchor location and each corresponding target location may in some cases allow the preassembly of relatively large structures or substructures to occur and target locations be identified and prepared with a more productive use of labour to do so, without the otherwise time consuming degree of care needed to locate and install suitable anchor structures positioning downwardly extending rigid bolts or studs which are spaced and aligned with one another in at least two dimensions to match target locations on a light fixture or substructure thereof.

Figure 13:
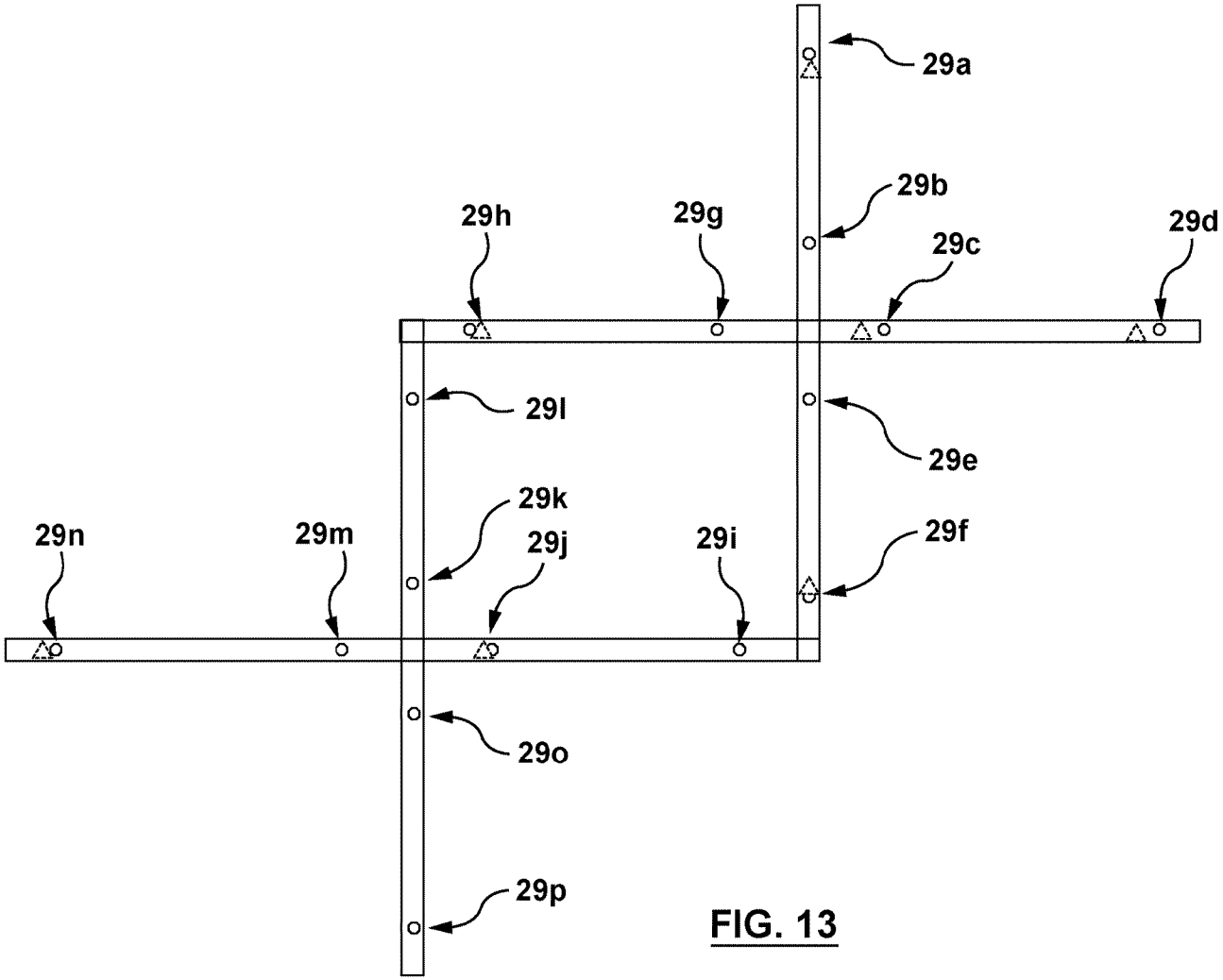
FIGS. 13 and 14 are schematic views of several methods.

The following provides an account of a conventional installation method that, for illustration purposes only, is presented as if such conventional method were to be used in an attempt to install a light fixture of the general shape of the light fixture made up of housing sections 12, 14 and the coupler 16, as represented schematically in FIG. 13. For the purposes of comparison only, like reference numerals are used to denote the anchor locations 29, it being understood that this discussion is not to be construed in any way to be an admission of prior art in relation to any of the exemplary embodiments of the present disclosure. With that in mind, and in relation to FIG. 13, a method to install the linear fixture of a complexity of light fixture 10 shown therein, might include:

ii) identifying anchor locations shown by the circles identified at 29*a*, 29*b*, 29*c*, 29*d*, 29*e*, 29*f*, 29*g*, 29*h*, 29*i*, 29*j*, 29*k*, 29*l*, 29*m*, 29*n*, 29*o* and 29*p;* iii) securing a t-bar connector at each such location, with each conventional t-bar connector having a single downwardly extending stud ready to extend through a passage (such as corresponding to aperture 68) whose location relative to the light fixture must be in an operable position in the target location array that would align with the axis of the stud in both the x and y dimensions of the ceiling;

iv) lifting the light fixture by several installers to a position adjacent the ceiling to align each of the passages in the target location array, with each corresponding at anchor locations 29*a*, 29*b*, 29*c*, 29*d*, 29*e*, 29*f*, 29*g*, 29*h*, 29*i*, 29*j*, 29*k*, 29*l*, 29*m*, 29*n*, 29*o* and 29*p* in the anchor array;

v) while several installers maintain the relative aligned locations of the target location array with each of the anchor locations 29*a*, 29*b*, 29*c*, 29*d*, 29*e*, 29*f*, 29*g*, 29*h*, 29*i*, 29*j*, 29*k*, 29*l*, 29*m*, 29*n*, 29*o* and 29*p* for step iii), identifying any studs in a misaligned position (as presented by the triangles at a, c, d, f, j, h and n);

vi) repositioning the identified misaligned studs in iv) and repeating iii) until all studs are aligned; and then vii) while maintaining the light fixture by several installers with the anchor and target location arrays aligned, threading fasteners progressively on the studs at anchor locations 29*a*, 29*b*, 29*c*, 29*d*, 29*e*, 29*f*, 29*g*, 29*h*, 29*i*, 29*j*, 29*k*, 29*l*, 29*m*, 29*n*, 29*o* and 29; and viii) connecting power from above the ceiling to a light source in the housing section 12.

Thus, in the above conventional method, the downwardly extending studs would be relatively nonflexible (or rigid) to the degree that cannot accommodate accumulated misalignments at target and anchor locations over the anchor and target location arrays as a whole, thus requiring possibility several iterations with several installers to ensure proper alignment and installation.

Figure 14:
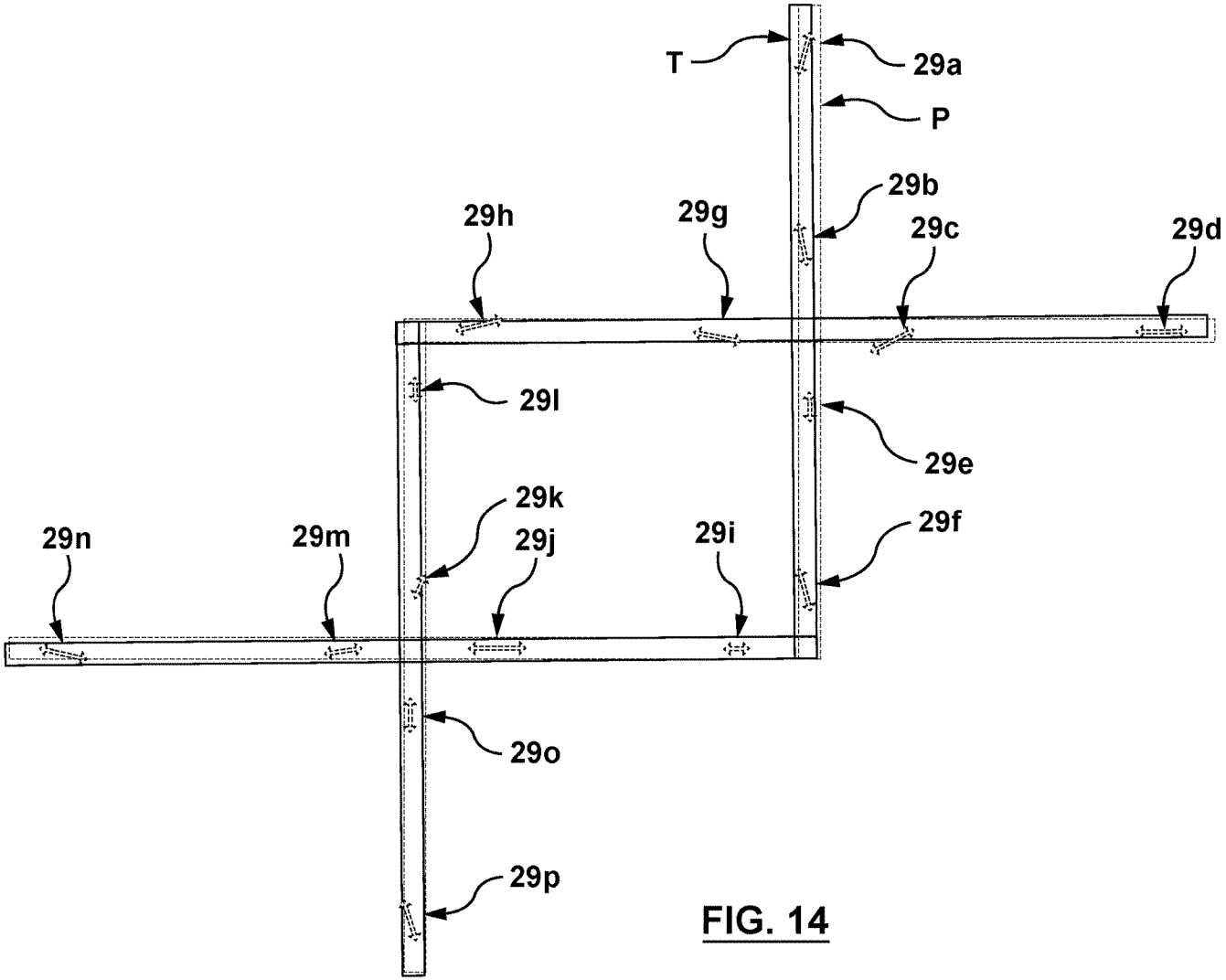

By sharp contrast, an exemplary method of the present disclosure is represented by FIG. 14, which may involve some or all of the following steps:

a) identifying the anchor locations 29*a*, 29*b*, 29*c*, 29*d*, 29*e*, 29*f*, 29*g*, 29*h*, 29*i*, 29*j*, 29*k*, 29*l*, 29*m*, 29*n*, 29*o* and 29*p;* b) securing an anchor structure at each such location to form the anchor array as shown in FIG. 1, with each anchor structure 28 having a single elongate flexible structure 38 ready to extend through a designated aperture 68 at a target location on the light fixture;

c) lifting the light fixture to a position adjacent the ceiling as shown in FIGS. 1 and 2, to insert each elongate flexible structure through each of the designated apertures 68 of the target location array, with each corresponding at anchor locations 29*a*, 29*b*, 29*c*, 29*d*, 29*e*, 29*f*, 29*g*, 29*h*, 29*i*, 29*j*, 29*k*, 29*l*, 29*m*, 29*n*, 29*o* and 29*p* in the anchor array;

d) while maintaining the light fixture in position, advancing each clamp structure 40 along the corresponding elongate flexible structures 38 to raise the light fixture, from the position as shown in FIGS. 2 and 6 to the position shown in FIGS. 3 and 7, to hold the light fixture 10 in a pre-mounting position;

e) installing power to a light source in the housing section; and f) advancing each of the clamp structure 40 along the respective elongate flexible structure 38 toward the installed position until the with the edge regions 64 are operatively positioned at the ceiling surface, which may involve (in the illustrated exemplary embodiment of FIG. 6, bringing the upper surface 61 of the inner frame portion against the lower surfaces 79 of the guide 74. (This step may be carried out, for instance, by the anchor 29*a*, 29*d*, 29*f*, 29*n* and 29*p* as the first to assemble the clamp structures in a progressive manner to the intermediate position shown in FIG. 6, followed remaining anchor locations and then "zipping" each of the clamp structures in a coordinated pattern to bring the light fixture to the installed position. Thus, the installation method explained here may be carried out by a single installer.)

In some exemplary embodiments, power may be supplied to a light source in the housing section following step f) rather than before as presented above.

The double headed arrows represent the degrees of misalignment that might be present at each anchor location/target location interface.

Thus, after step f), the cumulative effect of misalignment is demonstrated by the light fixture in a translated position shown in solid lines at T in FIG. 14, which is somewhat shifted to the left and counterclockwise rotation, compared with the non-translated position shown in dashed lines in FIG. 14. In this instance, the extent of the shift and rotation may be considered exaggerated for the purposes of illustration. The degree of the collective misalignment may be significantly less consequential and thus the delta in the movement to the translated position much less dramatic. Nonetheless, the present method may be seen to provide a substantial savings in time, effort and thus cost. Moreover, exemplary embodiments of the present method may allow for relatively large sub-assemblies of complex light fixtures including linear light fixtures to be constructed without the need for a piece by piece installation of smaller subassemblies or components of such complex light fixtures.

Thus, in some exemplary embodiments, the mounting assembly may provide the particular benefit of allowing edge regions of a linear light fixture housing to be positioned directly against a ceiling surface, in a manner that conceals the mounting assembly, that is with no features of the mounting assembly visible beyond the light fixture housing. Further, the mounting assembly establishes localized suspensions between anchor and target locations on the ceiling and the light fixture, along the corresponding arrays thereof.

In some exemplary embodiments, other features and structures may be integrated into the light fixture or between the light fixture and the ceiling, such as the conduit structure described in co-pending U.S. application Ser. No. 15/885,742, filed Jan. 31, 2018, and entitled CONDUIT ACCESS FOR LIGHT FIXTURES. Thus, the access for power and the mounting of the light fixture may be provided with separate structures, enabling both to be determined by independent factors. Thus, the target locations may be determined based on design criteria, while the conduit location(s) may be chosen for the same or other criteria, such as the availability or proximity of the power supply relative to different locations on the light fixture.

Further, in some exemplary embodiments, the mounting assembly and the above mentioned conduit structure may be used to provide for protection for the supply of power without being exposed to the exterior or entrained in the mounting assembly. For instance, a light source may be provided in module form integrating power supply delivery to individual LED's in an enclosed LED array, as well as providing optics for the linear light fixture assembly.

While the present disclosure describes various exemplary embodiments, the disclosure is not so limited. To the contrary, the disclosure is intended to cover various modifications and equivalent arrangements, as will be readily appreciated by the person of ordinary skill in the art.

The invention claimed is:

1. A mounting assembly for mounting a light fixture, comprising a plurality of anchor structures attachable to a ceiling at designated locations thereon to form an anchor array, wherein the anchor array is configured to be patterned so as to be complementary with a target location array of a plurality of target locations on the light fixture according to the anchor array, a plurality of elongate flexible structures according to the anchor array, of which each elongate flexible structure is configured to extend from a corresponding anchor structure in the anchor array so as to be orientable to align with a corresponding target location in the target location array, and a plurality of clamp structures according to the anchor array, of which each clamp structure is configured to be positionable on the corresponding elongate flexible structure and displaceable therealong to bring the light fixture toward the ceiling, each clamp structure being releasably lockable at a designated location on the corresponding elongate flexible structure, thereby to provide corresponding effective spacings between corresponding anchor structures and clamp structures to bring the light fixture into engagement with the ceiling, with the anchor and target location arrays in general alignment, wherein an installed position of the light fixture is defined by a cumulative effect of a relative positioning of each anchor location and each corresponding target location.

2. An assembly as defined in claim 1, wherein each array includes at least two sub-arrays, each extending in a designated direction.

3. An assembly as defined in claim 1, wherein the elongate flexible structure includes at least one cable, cable tie, rope, cord and/or chain.

4. An assembly as defined in claim 3, wherein each clamp structure includes a passage to receive the elongate flexible structure and a releasable lock element to lock the clamp structure at the designated location.

5. An assembly as defined in claim 1, wherein the elongate flexible structure includes a cable and the clamp structure includes a cable gripper.

6. An assembly as defined in claim 1, further comprising a guide configured to extend outwardly from the anchor structure to guide and/or locate the light fixture at the installed position.

7. An assembly as defined in claim 6, wherein the guide includes at least one guide structure with an exterior profile to engage an inner region of the light fixture.

8. An assembly as defined in claim 7, wherein the guide includes a pair of guide formations on opposite sides of the anchor structure.

9. An assembly as defined in claim 8, wherein the guide formations have at least one surface to engage at least one corresponding surface on the light fixture.

10. A light fixture assembly, comprising a plurality of anchor structures attachable to a ceiling at designated locations thereon to form an anchor array, at least one light fixture body defining a target location array of a plurality of target locations according to the anchor array, a plurality of elongate flexible structures according to the anchor array, of which each elongate flexible structure is configured to extend from a corresponding anchor structure in the anchor array so as to be orientable to align with a corresponding target location in the target location array, and a plurality of clamp structures according to the anchor array, of which each clamp structure is configured to be positionable on the corresponding elongate flexible structure and displaceable therealong to bring the light fixture body toward the ceiling, each clamp structure being releasably lockable at a designated location on the corresponding elongate flexible structure, thereby to provide corresponding effective spacings between corresponding anchor structures and clamp structures to bring the light fixture body into engagement with the ceiling, with the anchor and target location arrays in general alignment, wherein an installed position of the light fixture body is defined by a cumulative effect of a relative positioning of each anchor location with the corresponding target location.

11. An assembly as defined in claim 10, wherein the light fixture body comprises a longitudinal extrusion defining a longitudinal axis, with a lateral cross section defined by an inner frame portion and a pair of outer boundary portions, wherein the target location array extends along the longitudinal axis.

12. An assembly as defined in claim 10, wherein the pair of outer boundary portions provide a pair of edge regions which are configured to engage the ceiling on respective opposite sides of the designated first locations.

13. An assembly as defined in claim 11, wherein the inner frame portion is configured to define the target location array to be spaced from the pair of edge regions to define a passage through which each elongate flexible structure extends between the first location and the second location.

14. An assembly as defined in claim 13, wherein the passage includes a cavity between the frame portion and the boundary portions through which each elongate flexible structure extends between the first location and the second location.

15. An assembly as defined in claim 13, wherein the light fixture body is configured to shroud each clamp structure and the corresponding elongate flexible structure to limit access to a region therebetween, as the clamp structure approaches the designated location on the elongate flexible structure.

16. An assembly as defined in claim 15, wherein the light fixture body includes a chamber extending around a peripheral region of the clamp structure, wherein at least at the designated location on the elongate flexible structure.

17. An assembly as defined in claim 16, wherein the chamber is formed on a chamber member that is removably mountable to an inner surface of the light fixture body.

18. A method of mounting a light fixture on a ceiling, comprising:

a. locating a plurality of anchor structures on the ceiling at designated locations to form an anchor array, in a pattern so as to be complementary with a target location array of a plurality of target locations on a light fixture;

b. locating each of a plurality of elongate flexible structures at a corresponding anchor structure, so that each elongate flexible structure extends from the corresponding anchor structure in the anchor array so as to be orientable to align with a corresponding target location in the target location array;

c. providing a plurality of clamp structures, each to engage a corresponding elongate flexible structure according to the anchor array, so that each clamp structure is displaceable along a path defined on the corresponding elongate flexible structure in a direction to bring the light fixture toward engagement with the ceiling;

d. releasably locking each clamp structure at a designated location on the corresponding elongate flexible structure, thereby to provide corresponding effective spacings between corresponding anchor structures and clamp structures to releasably lock the light fixture in an installed position on the ceiling with the anchor and target location arrays in general alignment;

wherein the installed position is defined by a cumulative effect of a relative positioning of each anchor location with a corresponding target location.

19. A method as defined in claim 18, wherein each target location includes an aperture, further including extending each elongate flexible structure through a corresponding aperture.

* * * * *